United States Patent [19]

Stengel

[11] Patent Number: 5,009,537

[45] Date of Patent: Apr. 23, 1991

[54] BOOKLET BINDING SYSTEM

[75] Inventor: Philip B. Stengel, Cambridge, Minn.

[73] Assignee: Creative Binding Systems, Inc., Cambridge, Minn.

[21] Appl. No.: 290,563

[22] Filed: Dec. 27, 1988

[51] Int. Cl.[5] ..... B42F 13/04

[52] U.S. Cl. ..... 402/21; 402/60; 402/68; 412/34; 412/39

[58] Field of Search ..... 281/2, 5, 15.1, 21.1, 281/27.1, 27.2, 27.3, 29, 38, 51; 402/4, 79, 60, 68, 80 R, 80 P, 19, 20, 21; 412/34, 39, 40

[56] References Cited

U.S. PATENT DOCUMENTS

| | | | |
|---|---|---|---|
| 1,556,049 | 10/1925 | Trussell | 402/60 |
| 2,123,846 | 7/1938 | Cruzan | 402/60 |
| 2,139,480 | 12/1938 | Young | 402/60 X |
| 2,463,946 | 3/1949 | Brook | 402/60 |
| 4,773,787 | 9/1988 | Chang | 402/60 |

FOREIGN PATENT DOCUMENTS

| | | | |
|---|---|---|---|
| 694040 | 7/1940 | Fed. Rep. of Germany | 402/21 |
| 288445 | 1/1953 | Switzerland | 402/21 |

*Primary Examiner*—Paul A. Bell
*Attorney, Agent, or Firm*—John W. Adams

[57] ABSTRACT

This is a booklet binding system which includes an elongated closure unit specifically constructed and arranged to be removably inserted between the two rows of opposed spaced apart loops of a wire loop binding unit, wherein the closure unit defines a pair of spaced apart loop receiving grooves specifically oriented and arranged to receive the two rows of loops to interlock therewith and provide the desired closure therebetween.

3 Claims, 2 Drawing Sheets

BOOKLET BINDING SYSTEM

BACKGROUND OF THE INVENTION

There are a number of booklet binding systems presently being manufactured and sold on the market today. These include continuous spiral binders, wire loop binders, and resilient plastic binders.

The resilient plastic binders include a specific construction which is identified by the term "plastic comb" which employs a mechanical spreading device for retracting the curved fingers away from a back connecting bar to permit insertion of the fingers through the pre-punched sheets and then releasing the spreading device to close the back connecting bar around the fingers and capture the sheets on the fingers. Except for conventional split ring loose leaf binders, all of the present systems are constructed to permit only assembly of the paper sheets on the binding apparatus with the aid of a holding and/or spreading device and do not permit the sheets to be readily removed or additional sheets to be added to the bound booklet, without such a device.

Presently, wire loop binders require the opposed loop segments to be forcibly bent together with the aid of a special holding and bending device after the paper has been assembled thereon so that it is impossible to add sheets after the original assembly process.

SUMMARY OF THE INVENTION

The present invention relates particularly to a continuous wire loop binding unit which defines two rows of opposed spaced apart loops, one row defining hole receiving loops, the other row defining opposed connecting loops disposed along the other side of the binding unit. The invention includes an elongated closure unit removably inserted between the two rows of loops. The closure unit defines a pair of spaced apart grooves respectively receiving the two rows of loops to interlock therewith. In one form of the invention, a locking strip overlies a pair of hinged closure sections elements to hold the elements interlocked in closure position between the rows of loops. This assembly provides a substantially rigid bound edge which can be easily removed and replaced for easily adding or removing sheets from the bound pages.

DETAILED DESCRIPTION OF THE INVENTION

Figure 2:
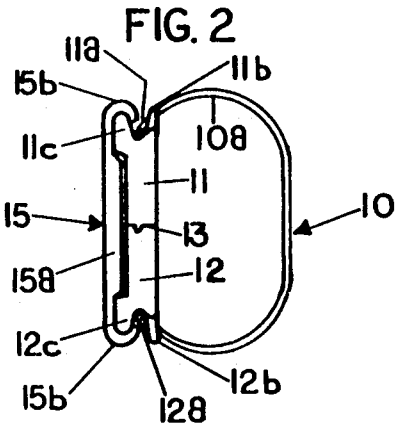
FIG. 2 is an end elevational view thereof.
Figure 6:
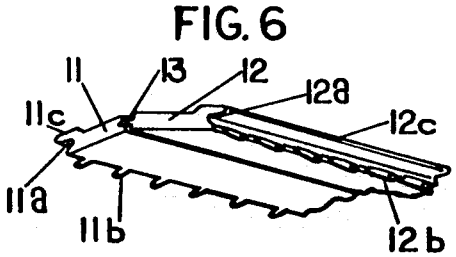
FIG. 6 is a perspective view of the hinged together closure sections.
Figure 1:
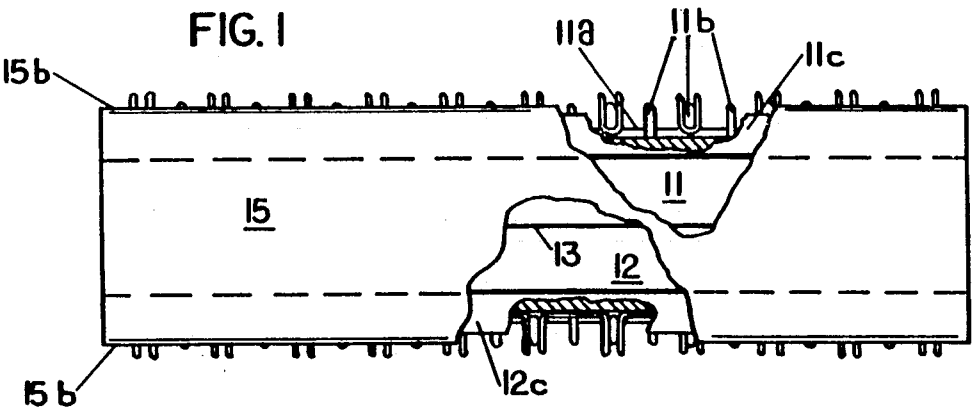
FIG. 1 is a top plan view of the binding assembly with portions broken away.
Figure 3:
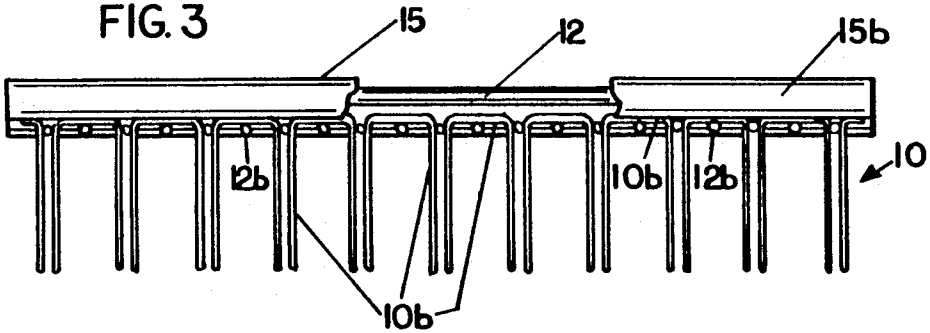
FIG. 3 is a front elevational view thereof.
Figure 5:
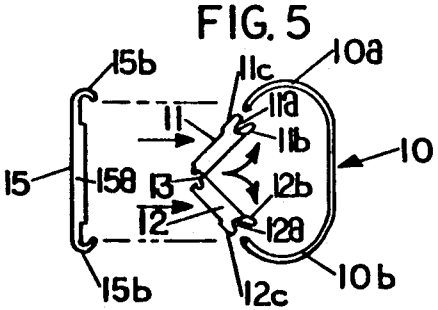
FIG. 5 is an end view showing the parts in exploded ready-to-be-assembled position.
Figure 4:
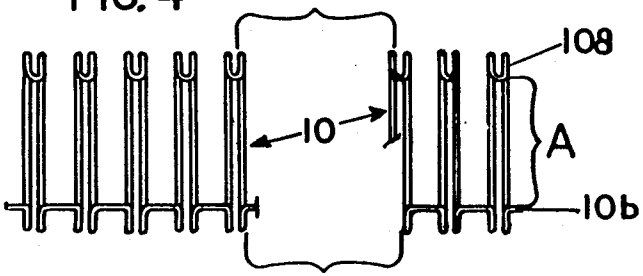
FIG. 4 is a top view of the wire loop binder per se.

A conventional wire loop binder unit 10 is best shown in FIGS. 4 and 5, and includes two opposed spaced apart rows of loops 10*a* and 10*b* defining an access space A between said rows. The loops 10*a* form narrow paper receiving loops or tines and are provided on one side of the space A. The loops 10*b* are provided on the opposite side of the unit 10 from the loops 10*a*. The respective loops 10*b* connect the respectively opposed loops 10*a* in the conventional manner.

A closure unit includes a pair of elongated closure sections 11 and 12 which are hingedly connected along their inner hinge line as indicated by the numeral 13. The sections 11 and 12 are substantially rigid except for the hinge connection 13 therebetween. The outside edges of each section 11 and 12 are provided with loop-receiving grooves respectively designated by the reference characters 11*a* and 12*a*. Individual tongue elements 11*b* and 12*b* are provided on each section and are generally opposed to each other; however, in the orientation illustrated alternate tongue elements 11*b* will receive the paper-receiving loops 10*a* and opposing tongues 12*b* will respectively receive the connecting loops 10*b*. Since the loops 10*a* and 10*b* are offset from each other the engaged tongues will be respectively offset from each other, as shown. The grooves 11*a* have tongue elements 11*b* which are received within the narrow loops or tines 10*a* and the grooves 12*a* have tongues 12*b* which are respectively received within the connecting loops 10*b*.

The two sections 11 and 12 are somewhat wider than the space A between the two rows of resilient wire loops 10*a* and 10*b* so that when the hinged sections are expanded laterally the loops are resiliently pressed into the grooves 11*a* and 12*a*.

Continuous clamping edges 11*c* and 12*c* are formed along the upper edges of the grooves 11*a* and 12*a* and receive a snap locking cover 15 which is provided with a relatively stiff thickened central back bone portion 15*a* and a pair of spring hook edges 15*b* and 15*c* are provided along opposite longitudinal edges thereof. These hooks spread apart under pressure on the back bone portion 15*a* and snap over the clamping edges 11*c* and 12*c* of the closure sections 11 and 12, to form a substantially rigid closure unit which may be easily and quickly removed to permit sheets to be added or removed from the narrow loops or tines 10*a*.

Figure 7:
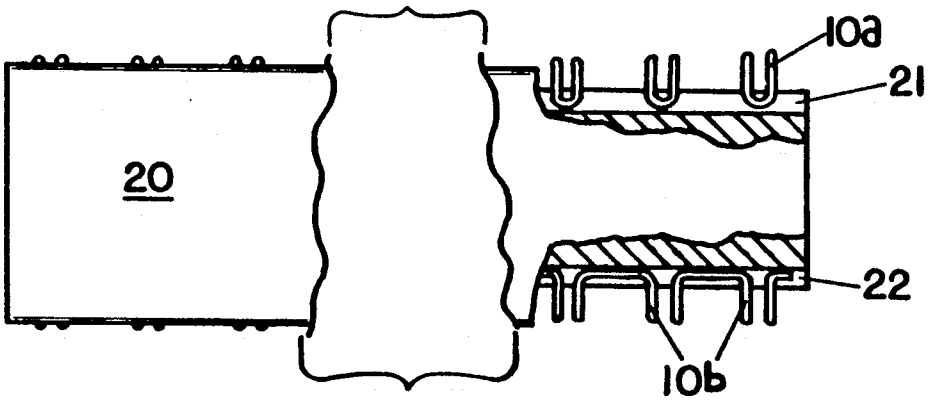
FIG. 7 is a top plan view of an alternate form of the invention mounted on a wire loop binder and having portions broken away.
Figure 8:
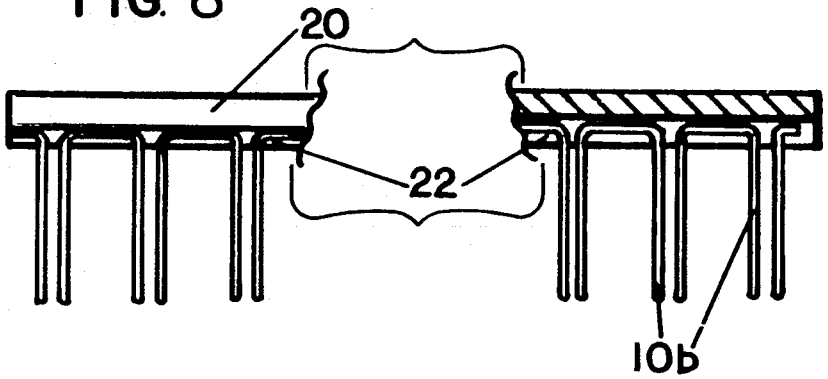
FIG. 8 is a front elevational view of the assembly shown in FIG. 7.
Figure 9:
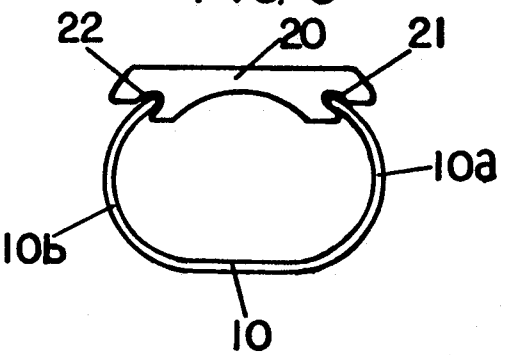
FIG. 9 is an end elevational view thereof.

An alternative unitary form of this invention is illustrated in FIGS. 7–9 of the drawings. In this form of the invention, the entire closure unit is made in the form of a unitary one-piece structure designated by the number 20. The one-piece unit 20 has a pair of grooves 21 and 22 formed on one side thereof. These grooves are inclined at the approximate angles of the tines or tongue elements 10*a* and 10*b* of the wire loop binder unit 10. The closure unit 20 is merely slid over the ends of the tines to close the area A disposed therebetween. The friction between the ends of the tines is generally sufficient to maintain the closure unit 20 in closed position thereon.

What is claimed is:

1. A booklet binding system for use with a wire loop binder of the type having a pair of opposed spaced apart rows of loop segments, wherein one of the segments forms narrow tine elements adapted to be received through the holes of pre-punched sheets and the other segment being connecting loops to provide a continuous wire loop binder, a closure removably mounted in the space between the two opposed loop segments to capture the sheets mounted on the tine elements of the wire loop binder, said closure including a pair of spaced apart loop receiving grooves for respectively receiving the spaced apart ends of the two rows of loop segments, means for retaining the closure in binding position between the ends of the loop segments, and wherein the loop receiving grooves are orientated to alone slope inwardly to maintain the closure in interlocked binding position between the two rows of loop segments, and wherein the closure comprises a pair of elongated sections hingedly connected longitudinally thereof to facilitate insertion of the loop segments into the grooves defined therein.

2. The structure set forth in claim 1 and a plurality of spaced apart loop engaging tongue elements received in the space between the opposed binding loop segments to prevent longitudinal movement of the closure after the same has been mounted between the opposed loop segments.

3. The structure set forth in claim 1 and means for positively holding the two closure segments in expanded position with the loops locked into the loop receiving grooves thereof.

* * * * *